US006257418B1

(12) United States Patent
Allen et al.

(10) Patent No.: US 6,257,418 B1
(45) Date of Patent: Jul. 10, 2001

(54) RETRACTABLE DISPLAY APPARATUS

(76) Inventors: Troy D. Allen, 775 E. Columbia, Meridian, ID (US) 83642; Rich Segali, 9260 Sunflower La., Boise, ID (US) 83704

( * ) Notice: Subject to any disclaimer, the term of this patent is extended or adjusted under 35 U.S.C. 154(b) by 0 days.

(21) Appl. No.: 09/488,913

(22) Filed: Jan. 19, 2000

Related U.S. Application Data

(60) Provisional application No. 60/116,420, filed on Jan. 19, 1999.

(51) Int. Cl.[7] ..... A47F 5/00

(52) U.S. Cl. ..... 211/1.3; 211/204; 211/119.01; 40/604; 40/617

(58) Field of Search ..... 211/1.3, 195, 196, 211/204, 119.1, 119.01, 119.03; 40/603, 604, 617

(56) References Cited

U.S. PATENT DOCUMENTS

| | | | | |
|---|---|---|---|---|
| 1,991,087 | * | 2/1935 | Falcon . | |
| 2,206,174 | * | 7/1940 | Falk . | |
| 3,193,212 | * | 7/1965 | Lotta . | |
| 4,261,469 | | 4/1981 | Stone | 211/119.1 |
| 4,434,570 | * | 3/1984 | Roos | 40/617 |
| 4,434,898 | * | 3/1984 | McCarthy | 211/1.3 |
| 4,519,509 | | 5/1985 | Doyle | 211/119.13 |
| 4,553,715 | | 11/1985 | Roselli | 242/10 |
| 4,688,657 | | 8/1987 | Erickson | 182/142 |
| 4,872,632 | | 10/1989 | Johnson | 248/332 |
| 4,972,794 | | 11/1990 | Smyly, Sr. | 116/173 |
| 5,305,708 | | 4/1994 | Keisler | 119/17 |
| 5,529,274 | * | 6/1996 | Anderson et al. . | |
| 5,575,046 | | 11/1996 | Rourke | 24/563 |

* cited by examiner

*Primary Examiner*—Robert W. Gibson, Jr.
(74) *Attorney, Agent, or Firm*—Barbara S. Pedersen; Ken J. Pedersen

(57) ABSTRACT

The present invention is a retractable display apparatus comprising at least one upright support having at least one retractable cord able to extend generally perpendicular to the stanchion, said cord able to attach to an object or preferably a matching stanchion. Preferably, each stanchion is a T-shape, but may be other shapes, for example, an inverted L shape, which has a riser plus one horizontally-extending side arm at or near the top of the riser. Retractor mechanisms and locking mechanisms are preferably included for each cord, for easy and neat handling of the cord, preferably by winding the cord on a rotating member ("spool"). The apparatus is adapted so that the cord(s) support one or more signs or banners or other items that might be decorative or functional for a retailer, warehouse, flea market, or other business. Additionally, signage may be installed generally in the plane of the stanchions, so that signage may be seen on all four sides of the generally rectangular space defined by the two-stanchion, two cord apparatus.

10 Claims, 6 Drawing Sheets

RETRACTABLE DISPLAY APPARATUS

This application claims priority of our prior, co-pending provisional patent application, Ser. No. 60/116,420, filed on Jan. 19, 1999 entitled "Retractable Display Apparatus," which is incorporated herein by reference.

BACKGROUND OF THE INVENTION

1. Field of the Invention

The present invention generally relates to retail advertising. More specifically, this invention relates to methods and apparatus for hanging advertising signs, decorations or other matter within a retail store.

2. Related Art

The currently utilized method for hanging signage within a retail store involves cutting a cord (or string or wire) a desired length, stretching the cord over an area, and fastening the ends of this cord to an object or a wall within the store. Signage can then be suspended from this suspended cord. However, if the user determines that he or she wishes to change the location or length of the cord, the user must take down the entire display, discard the old cord and cut a new cord the length needed.

Apparatus for stretching a cord across an area exists, for instance U.S. Pat. No. 4,261,469 (Stone), which discloses a clothesline that may be disassembled for storage. However, the Stone invention does not disclose an apparatus having a retractable cord, and does not disclose several of the other features of Applicants'invention. Other apparatus exists for retracting a cord, for instance U.S. Pat. No. 4,553,715 (Roselli), which discloses an "extendible line." However, the Roselli invention does not disclose a T-shaped stanchion or several of the other features of Applicants'invention.

Therefore, there is still a need for an efficient, attractive display device that may be used in a retail setting to provide professional and neat signage. There is still a need for such a device that may be used safely by many individuals without substantial training or skill.

SUMMARY OF THE INVENTION

The present invention in an apparatus comprising at least one T-shaped stanchion having a retractable cord for stretching across an area, said cord used to hang advertising or decorations upon. Preferably, the retractable cord is extendable generally perpendicularly to the stanchion, and attachable to an object or, preferably, to another matching T-shaped stanchion.

A first benefit of the present invention is that the present invention is quicker to set up and quicker to take down than the prior method of cutting a length of cord a desired length. Use of the present invention, by being retractable, eliminates the prior method step of measuring the distance across the area to be spanned and cutting the cord to approximately match the distance. Instead, the user merely needs to wind the cord out of the present invention and stretch to the desired length and attach the cord to a second T-shaped stanchion or other object.

A second benefit of the present invention is that by eliminating the need to cut the cord, there is no cord wasted or discarded. The cord used on one project is reused in the next project, saving energy and the environment. Because the cord is retractable, there need not be loose, tangled, or coiled cord or other string lying around the store's floor, and, therefore, there are fewer dangers to workers and customers.

A third benefit is that the use of the present invention is much more attractive and aesthetically pleasing than the prior art methods of hanging advertising and other decorations. Use of the present invention quickly and easily results in a consistent and even display, unlike the prior way that required much skill and effort to get multiple cords level and even. Also, because the retracted cord of the invention is preferably wound around members of the stanchion, and, more preferably, wound up inside members of the stanchion, attachment of the cord to its supporting members is inherently neat and attractive. There is no need for knots, nails, tacks, or hangers, or other fasteners to be visible or to be inserted into wall or ceiling surfaces.

A fourth benefit is the ability to easily change the length and location of the area covered by the display. When a change in signage location is desired, the user is not required to take down the original cord and then measure and cut a new one. Instead, the user just needs to pull out more of the cord and then move the T-shaped stanchion further away from the cord's attachment to another T-shaped stanchion or object. The user can even change the location of the display by merely moving the T-shaped stanchion or stanchions. While the prior art retail displays have not been movable, the present invention may be a free-standing display, independent of other structure except the floor or other preferably horizontal surface upon which the invention stands.

A fifth benefit of the present invention is that the attachment of the signage is very secure and reliable. The present invention is preferably attached by placing a hook or other fastener, which is preferably permanently connected to the distal end of the retractable cord, through a hole or other opening in the object or other T-shaped stanchion or extending therefrom. The prior way required the use of an attachment to/into wall, such as a thumbtack, or the use of a knot tied in the cord to the object attached to. Such prior attachment was unsightly and possibly damaging to the wall, was not secure, and could easily come unattached. This security has the further benefit of safety--there is a less likelihood of a person being injured by a falling cord or signage or becoming tangled in the cord or signage.

BRIEF DESCRIPTION OF THF DRAWINGS

DESCRIPTION OF THF PREFERRED EMBODIMENTS

Referring to the Figures, there is shown one, but not the only, embodiment of the invented retractable display device. In this application, the following terms have the following meanings unless explicitly indicated otherwise within this application: "proximal" means near the T-attachment 23, "distal" means away from the T-attachment 23.

Figure 1:
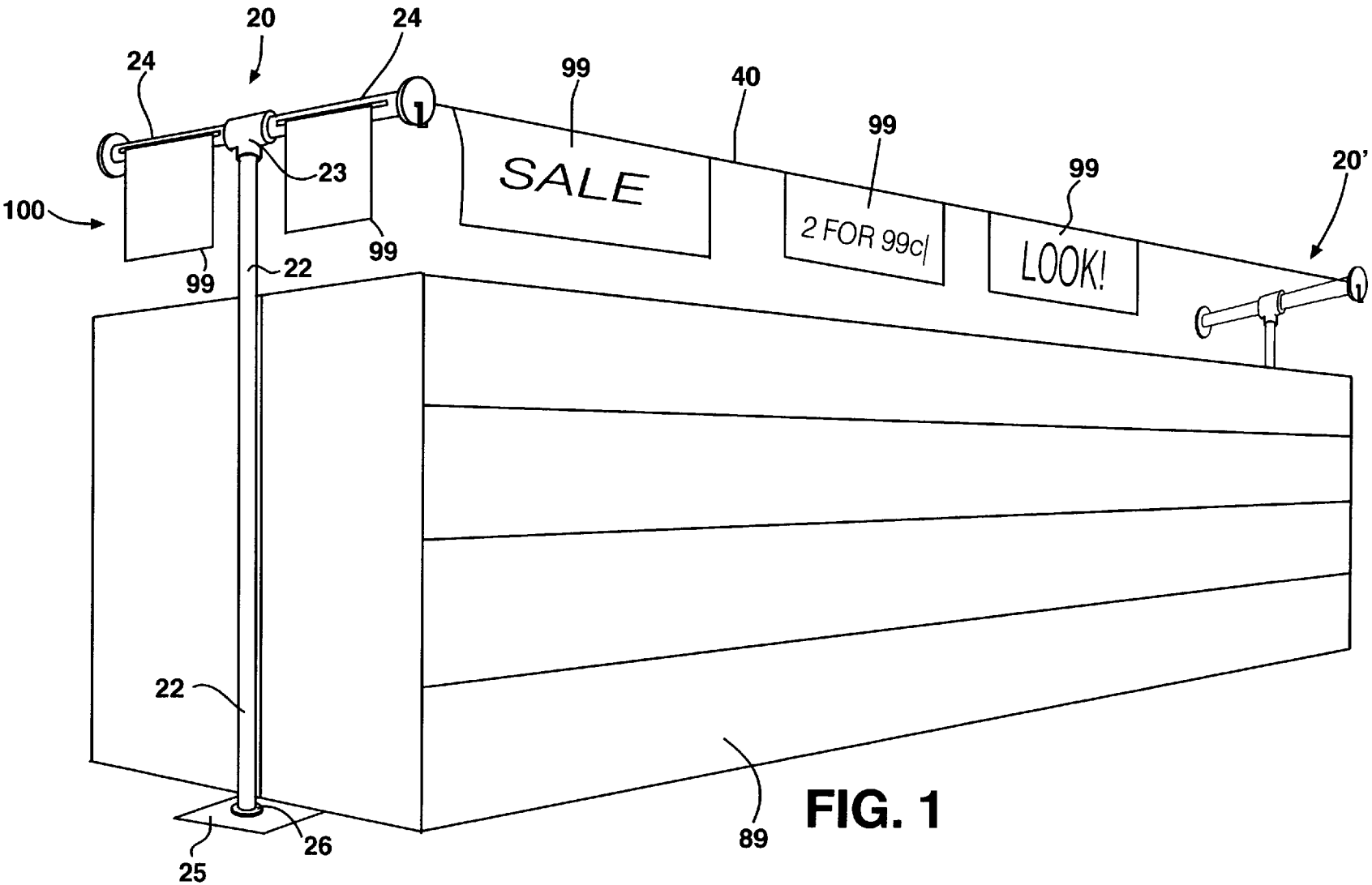
FIG. 1 is a side perspective view of one embodiment of the present invention in use, shown with attached signage and stretched over a stack of shelves.

Retractable display device 100 comprises a T-shaped stanchion 20, a cord retractor 30, a cord 40, and, preferably, a cord connector 80. FIG. 1 shows the preferred embodiment of the device 100 in use with attached signage 99 and stretched over a stack of shelves 89. In this configuration, the device 100 extends across an elongated space, so that, for example, one of the devices 100 could be installed over each of several stacks of shelves with shopping isles in-between. FIG. 1 shows the cord 40, which is anchored, and preferably retractable into, the first generally vertical stanchion 20, and extending through the air generally horizontally to a second, generally vertical, T-shaped stanchion 20'. Attachment to a second stanchion 20', spaced from the first stanchion 20, is the preferred method of use of the present invention 100, however, attachment of the cord distal end to an object other than a second stanchion is also envisioned, for example, a hanger on a wall, a bar upending from the shelves, or a grating or partition.

The T-shaped stanchion 20 is for support and elevation of the cord 40, preferably over stacks of goods 89 or a walkway. The T-shaped stanchion 20 further comprises a base 25 for contacting the ground or floor surface and stabilizing the stanchion 20; a base attachment 26 for attaching the base to a first portion of the riser 22; a riser 22 extending generally upward from the base attachment 26; a T-attachment 23 where the second portion of the riser 22 attaches generally perpendicularly at or near the center of the length of the extension arm 24; and an extension arm 24.

The base 25 can be a plate, as shown in the Figures, or could be of another form, such as a tripod (not shown). The base 25 serves to anchor or otherwise attach the device 100 to the floor surface upon which the present invention 100 is used. The base 25 is preferably made of a size and weight sufficient to itself solely anchor and stabilize the device 100, or may be made so that a stack of shelves 89 or other weighted device is placed upon the top surface of the base 25 to anchor the base 25, as shown in FIG. 1. Preferably, base 25 is relatively heavy in comparison to the rest of the stanchion 20, thereby reducing the chances the invention 100 can be knocked over. Therefore, the base preferably rests on, but is preferably unattached to any building structure. Optionally, but less preferably, the base 25 may be permanently or semi-permanently attached to the floor, for example, by screws of other fasteners.

The base attachment 26 is preferably located in the center of the upper surface of the base 25, and serves as the attachment point between the base 25 and the first portion of the riser 22 that extends generally vertically from the base 25. The preferred attachment 26 is an inwardly threaded orifice mounted on the top surface of the base 25, said orifice for receiving a first portion of a riser 22 having threads located on its outside surface. In this way, the riser 22 can be removably attached to the base 25, allowing the user to screw the riser 22 into the attachment 26 when assembling the device 100, and allowing the user to unscrew the riser 22 from the attachment 26 when wishing to disassemble the apparatus 100. Alternatively, the attachment between the base and the riser may include other or additional structure—for example, the riser may be hollow and slide down upon a smaller diameter cylinder and include a set screw or other lock to keep the riser securely on the base.

The riser 22 is a small diameter (preferably about 2–4 inch) elongated piece extending generally upwards from its attachment 26 with the base 25. The preferred riser 22 comprises a metal pipe having threaded ends. A first threaded portion of the riser 22 is threaded and received into the attachment 26 and attaches to the base 25. The riser 22 extends vertically to the second portion of the riser 22 that is threaded and received into lower threaded orifice of the T-attachment 23.

Figure 2:
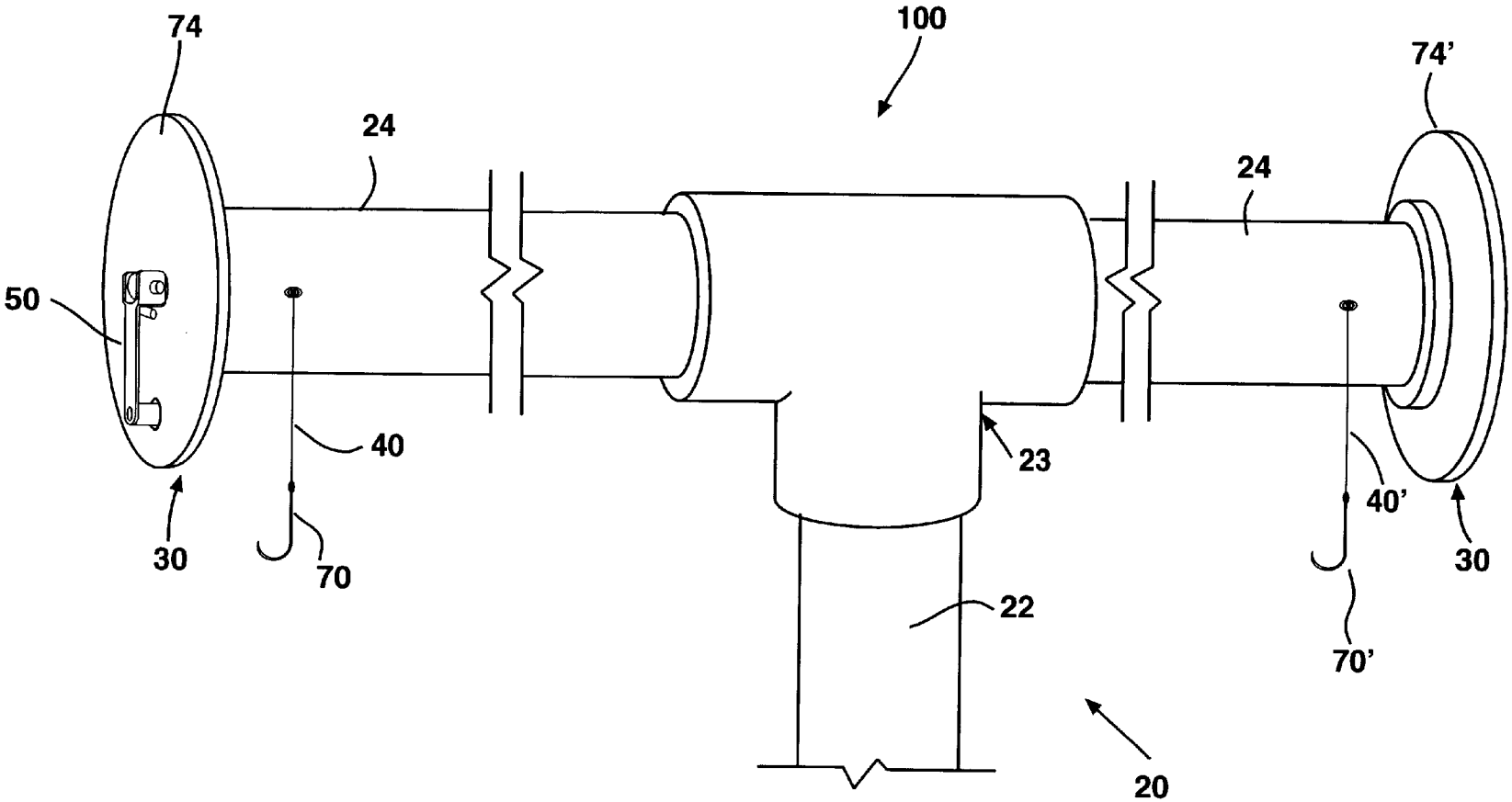
FIG. 2 is a partial, front, perspective view of the embodiment shown in FIG. 1.

As shown in FIG. 2, the T-attachment 23 attaches the riser 22 to the extension arm 24. Preferably, the T-attachment 23 has a threaded orifice for receiving a threaded end of the second portion of the riser 22. The preferable extension arm 24 is one piece that extends generally horizontally through the T-attachment 23, to extend straight out on both sides of the T-attachment 23, so that the T-shaped attachment 23, in effect, attaches the riser 22 to the extension arm 24 at or near the center of said extension arm 24. Alternatively, a pair of two separate extension arms may be connected to the T-attachment, for example, two arms having threaded ends received into threaded orifices located within the T-attachment 23. The result of the preferred attachment is a perpendicular attachment between the generally vertical riser 22 and the generally horizontal extension arm 24 or extension arms.

Figure 3A:
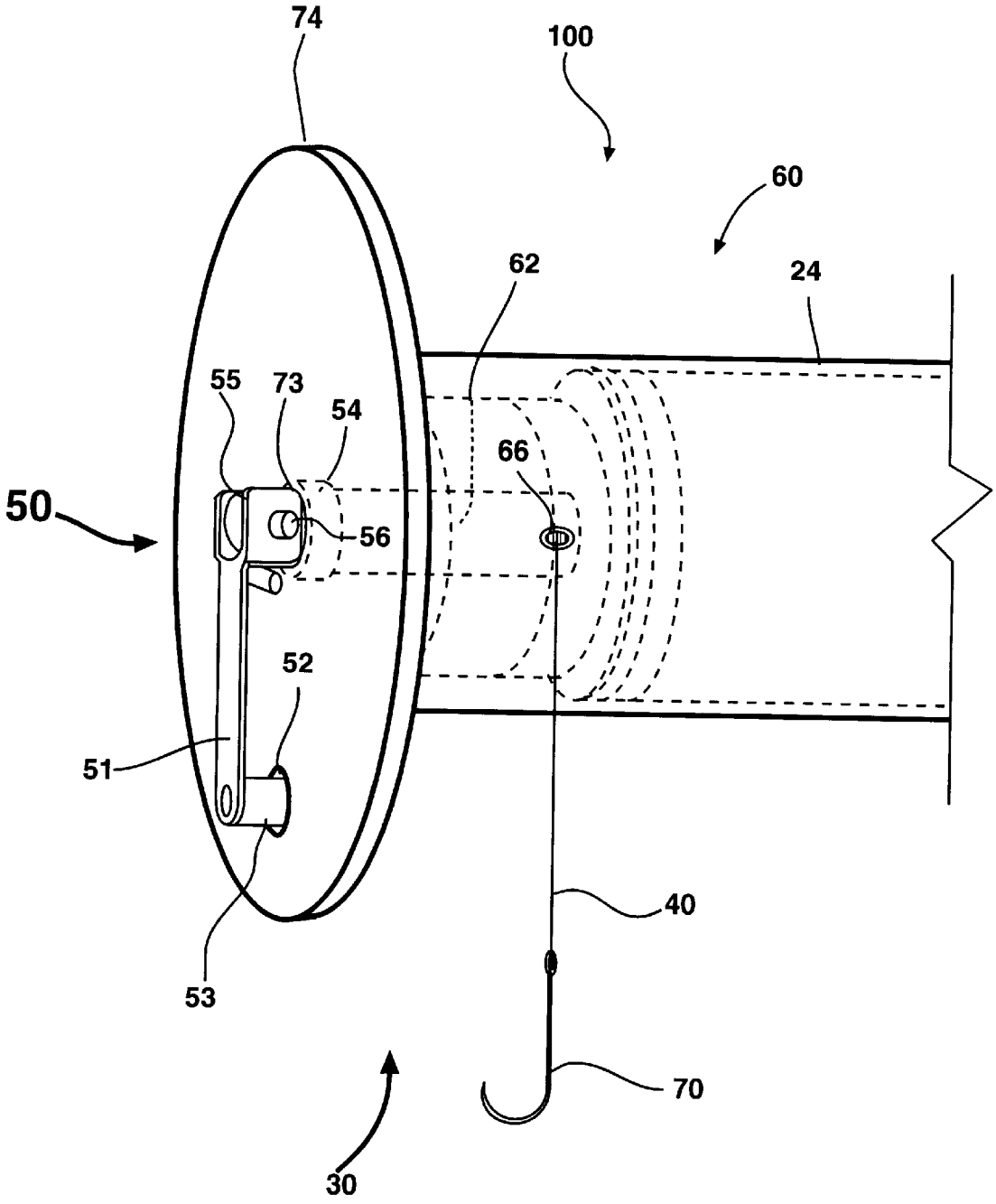
FIG. 3A is a side perspective view of the embodiment shown in FIG. 1, said view showing one embodiment of the reel end of the invention.
Figure 3B:
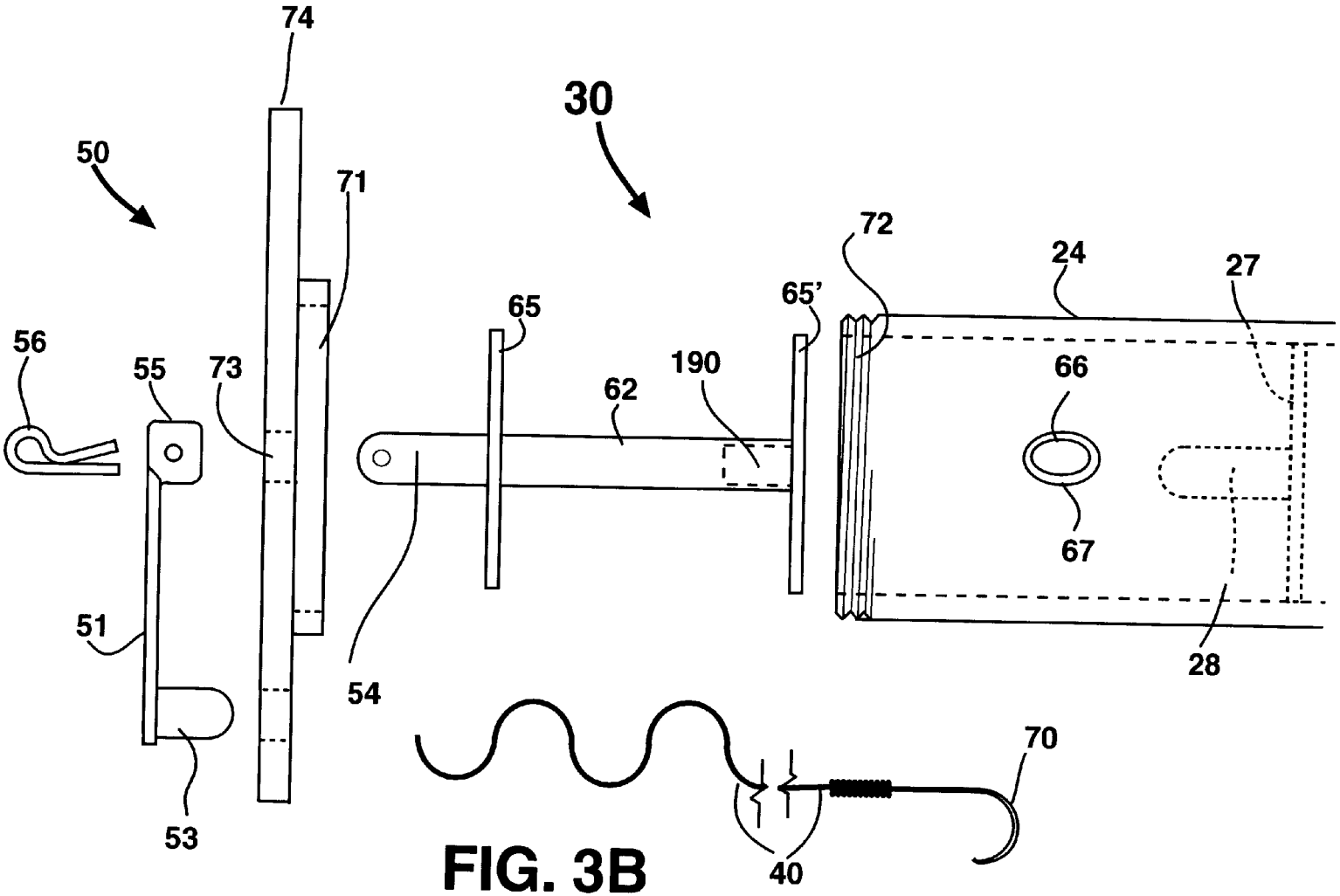
FIG. 3B is a side, exploded view of the embodiment shown in FIG. 3A.
Figure 4:
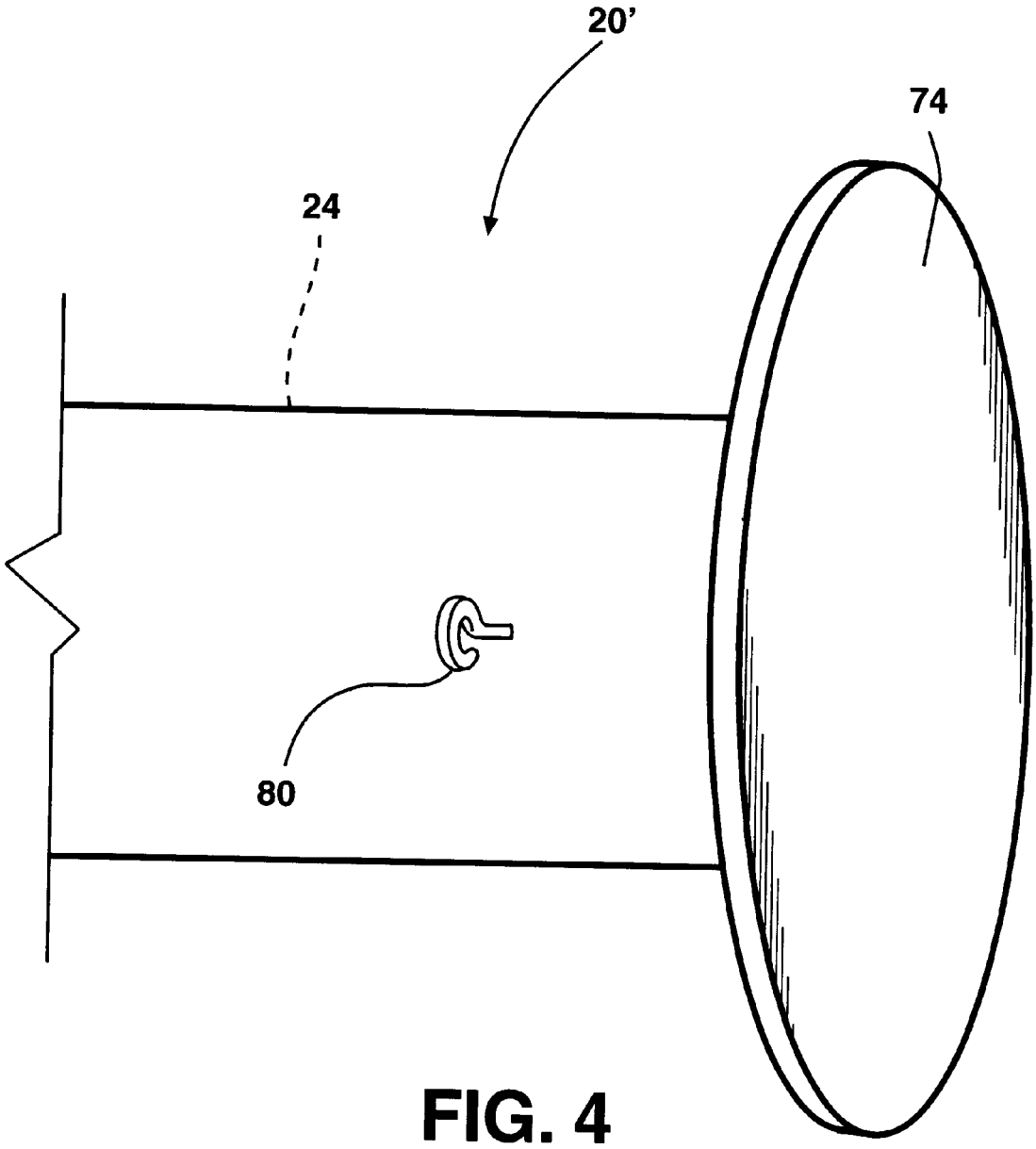
FIG. 4 is a side perspective view of another embodiment of the present invention, said view showing a cord receiving end of a second T-shaped stanchion.

The extension arm 24 is preferably a small diameter (2–4 inch) elongated member, relatively short member, that is, preferably extending out about 1–2 feet on each side of the riser, compared to the riser, which is preferably about 7–10 feet long or longer. The extension arm 24 preferably comprises a metal pipe having threaded ends. The extension arm 24 serves to place each cord retractor 30 a horizontally distance from the riser 22. As shown in FIG. 3A and 3B, preferably, the extension arm 24 is hollow for receiving a cord retractor 30 internally. The hollow arm 24 may be capped at its outer extremities, for example, by having an outwardly threaded end or ends for attachment to one or more end caps 74. Alternatively, and shown in FIG. 4, the extension arm 24 may also or alternatively comprise a cord connector 80 for receiving the cord 40 and/or the cord hook 70 of an adjacent stanchion.

Referring again to FIGS. 3A and 3B, preferably two cord retractors 30 are located in or near the distal ends of the extension arm 24, as shown in FIG. 2. Other cord retractor 30 locations along the entire length portion of the extension arm 24 are also envisioned by the inventors, for example, near the center of the arm 24 as well as the ends. This would create a multiple-cord retractor 30, for instances in which more the one of two cords stretching between two stanchions are desired.

Referring again to FIGS. 3A and 3B, the preferred cord retractor 30 comprises: a handle mechanism 50 for manual winding and unwinding the cord; an end cap 74 for holding the cord retractor 30 within the extension arm 24; a spindle apparatus 62 for winding the cord 40; a pay-out hole 66 for allowing the cord 40 to pass through the wall of the extension arm 24 and be wound around the spindle apparatus 62. Each cord retractor is therefore well-adapted for cooperation with a long cord 40, so that pulling of the cord out from the pay-out hole 66 serves to unwind the cord from the spindle for extension of the cord between the present invention 100 and another object or other stanchion. The cord 40 should be of sufficient strength for repeated windings and unwindings, and well-adapted for attachment and hanging of signage along its length, for example, by the cord passing through loops in the signage, or the signage being tied to the cord.

Preferably, the handle mechanism 50 further comprises: a handle tab 53 for grasping by the user; a handle 51 for maneuvering the spindle attachment 55, a spindle attachment 55, and an attachment pin 56. The handle tab 53 is an optional piece, assisting in making the handle 51 easier to turn. In the preferred embodiment, the handle tab 53 is able to be inserted into a tab hole 52 located in the end cap 74. Inserting the tab 53 into the tab hole 52 inhibits movement of the handle 51, thereby inhibiting movement of the spindle apparatus 62 and thereby locking the cord 40 in place, keeping any more of the cord 40 from paying out.

The handle 51 extends from the spindle attachment 55 where the handle mechanism 50 attaches to a first portion 54 of the spindle 62 that extends through a spindle hole 73 located in the end cap 74. The handle 51 is able to pivot at the spindle attachment 55, thereby allowing the handle 51 to be flipped 180 degrees so as to move the handle tab 53 from a position facing the end cap 74 to a position where the tab 53 is on the opposite side of the handle 51 than the side of the handle 51 that faces the end cap 74. This allows the user to use the tab 53 to wind and unwind the cord 40 more conveniently.

The spindle attachment 55 attaches to the first portion 54 of the spindle 62 through the use of an attachment pin 56 inserted through holes located in the spindle attachment 55 and the first portion 54. This attachment allows the turning of the handle 51 to cause the turning and rotation of the spindle 62.

The end cap 74 serves to cap the end of the extension arm 24, thereby holding the spindle apparatus 60 within the extension arm 24. The preferred end cap 74 has a thread receiving portion 71 for receiving the end of the extension arm 24 having threads 72. The end cap 74 has a spindle hole 73 through the center of the cap 74 allowing the end 54 of the spindle 62 to be inserted though the cap 74. The end cap 74 also may contain a tab hole 52 (or holes spaced radially around the circumference of the cap 74) for the insertion of the handle tab 53, thereby locking the handle 51 and spindle 62 in place, inhibiting their rotation. The inventors envision several other possible locking mechanisms for locking the cord retractor in a desired position and maintaining the preferred amount of tension on the cord, once the desired length of cord is extended and connected to the second stanchion of other object. These mechanisms may include conventional locking means for winding devices, but the preferred mechanism is the simple and effective tab 53 in hole 52.

The spindle apparatus 60 is for winding and storing the cord 40 within the extension arm 24. The preferred spindle apparatus 60 comprises a rod shaped spindle 62 interposed between a pair of spindle disks 65, 65'. The proximal end of the rod shaped spindle 62 is hollow, and the center of the proximally located disk 65' has a hole extending therethrough, thereby creating a post hole 190 for receiving a spindle support post 28. A first portion 54 of the spindle 62 extends distally from the center of the distally located disk 65. The disks 65, 65' serve to keep the spindle 62 centered within the extension arm 24, and are able to rotate within the extension arm 24.

The cord 40 is attached to the spindle 62 through any manner of means, including tying the end of the cord 40 around the spindle 62 (not shown). Thus, as the spindle 62 initially rotates either clockwise or counter clockwise, the cord 40 is wound upon the spindle 62. The cord 40 extends out of the extension arm 24 through hole 66 located through the extension arm 24. Preferably this cord hole 66 is lined with a rubber or other grommet 67 for protection of the cord 40 against frictional wear as the cord is wound and unwound.

The inventors envision other retractor designs, which may be automatic or manual. Their preferred design is a simple, manual one that is generally easy and reliable and durable.

Attached to the distal end of the cord 40 extending out of the extension arm 24 is an attachment hook 70 or other fastener. This fastener 70 is used to attach the cord 40 to an object or, preferably, another T-shaped stanchion 20', as shown in FIG. 1. Preferably, the opposing stanchion 20' further comprises a cord connector 80, such as the hoop shown in FIG. 4, for cooperating with the fastener 70 for securement/anchoring of the cord 40 during use. Alternatively, no fastener could be used and the cord 40 could merely be tied to the connector 80 or other object.

Referring again to FIG. 3B, preferably the post hole 190 of the spindle apparatus 60 is received onto a spindle support post 28 extending distally from the distal side of an inner cap 27 located within the extension arm 24. This axially-extending post 28 serves to center the spindle apparatus 60 within the extension arm.

The cord retractor 30 of the preferred embodiment of the device 100 is preferably assembled as discussed below. First, the inner cap 27, having an attached inner support post 28, is inserted into and attached within the hollow central space of the extension arm 24, preferably by a weld. Then, the end of the cord 40 that is not connected to the attachment hook 70 is inserted from the outside of the extension arm 24 through the cord hole 66 and into the inside of the extension arm 24. Then, this end of the cord 40 is then attached to the spindle 62. The spindle 62, is then carefully inserted into the extension arm 24 to the point that the post hole 190 of the spindle 62 is slid fully onto the spindle support post 28, carefully adjusting the cord 40 as such insertion takes place. Then the spindle hole 73 is placed over the first portion 54 of the spindle 62, allowing the first portion 54 to extend through the spindle hole 73. The threads 72 of the extension arm 24 can then be screwed into the threads 71 within the end cap 74. When the end is capped, the user can then place the spindle attachment 55 over the end of the first portion 54 extending distally through the end cap 74, insert the attachment pin 56 through holes located in the attachment 55 and through holes located within the first portion 54 of the spindle 62. This attaches the handle 50 to the cord retractor 30. The user then could turn the handle 50 and wind the excess cord 40 within the extension arm 24.

The inventors' envision that a spring mechanism or other biasing mechanism may be used to urge the cord into a wound-up position, if desired. Such a mechanism would be adjusted to not place un-do tension of the cord but to assist in winding up of the cord.

As shown to best advantage in FIG. 1, the preferred two stanchions are aligned parallel to each other and spaced a desired distance. The two cords are extended between the ends of the arms 24, creating, in effect a rectangular shape made of arms 24 and cords. Several signs (99) may be hung at various locations along the extended cord, or, a single long sign may be hung, preferably with the indicia on the signs facing outward from the center of the rectangle. Alternatively, the cords may be crossed in mid-air to connect to the opposing arm 24 end, but this would normally be done only for a special decorative effect.

Figure 5:
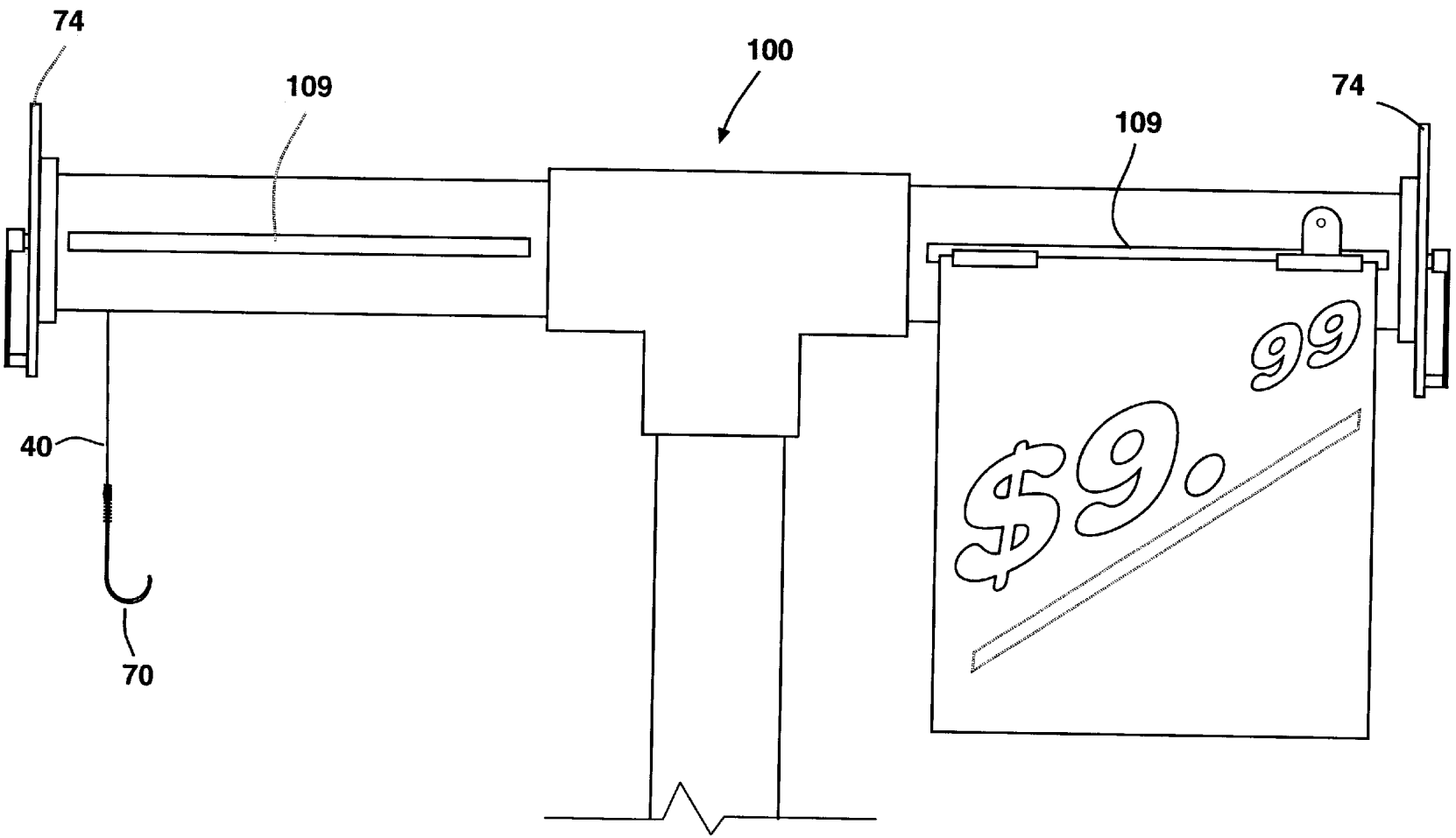
FIG. 5 is a side view of the embodiment shown in FIG. 1.

In addition to the signage on the cords, signage may be hung perpendicularly to the cord, that is, generally in the plane of the t-shaped stanchions, to hang signs at the end of the runs of shelves, for example, to describe in general the contents in the isle. This signage on the stanchions may be connected by use of a hanging strip 109 on the arms 24, as shown in FIG. 5. The hanging strip 109 is preferably of steel or other metal for the attachment of magnets for assisting in the holding of the signage 99. Alternatively, the hanging strip 109 could be adapted for receiving a clip or other type attachment for holding of the signage, for example, a series or line of loops, hooks, or tabs on the arms 24 that easily receive the signage or clips that hold the signage. A metallic hanging strip 99 may only be necessary where the stanchion is made from aluminum or pvc, or other non-magnetic material. The hanging strip 99 is preferably located on the side of the apparatus 100 opposite the cord hole 66.

The present invention is used by first unlocking the handle 50 from the end cap 74, if the handle 50 is locked using the tab 53. The user then merely needs to grasp the hooked 70 end of the cord 40 and pull the cord 40 out of the extension arm 24 the distance needed. The user then attaches the hook 70 to an object, preferably the connector 80 of the second T-shaped stanchion 20'. Then, the user turns the handle 50 to take the slack out of the cord 40, and preferably locks the handle in place.

While the inventors believe the ideal material for the T-shaped stanchion 20 is aluminum, other metals and even the use of a plastic, such as PVC, is also envisioned.

We claim:

1. A display device for hanging items in the air, the device comprising:

a first upright support having a top and a bottom, a base on the bottom for resting on a generally horizontal surface, a generally vertical riser, having a generally horizontal arm extending from the top;

a cord having a proximal end and a distal end, the proximal end connected to the horizontal arm;

a retractor mechanism having a spool, the retractor mechanism attached to the horizontal arm and operatively connected to the cord to wind the cord on the spool; and a second upright support having a top and a bottom, a base on the bottom for resting on a generally horizontal surface, having a generally horizontal arm extending from the top;

wherein the second upright support comprises a connector at or near its top for receiving the distal end of the cord;

wherein the first upright support and second upright support are spaced from each other on the horizontal surface, the cord is pulled out from the retractor mechanism and the distal end of the cord is connected to the connector, and wherein the cord is adapted to support signs and decorations.

2. The device of claim 1, wherein the horizontal arm has a hollow portion and the retractor mechanism is substantially contained within the hollow portion.

3. The device of claim 1, wherein the arm extends out two directions from the riser and has two outer ends, the device comprising two retractor mechanisms, one retractor mechanism being in each of the two outer ends, and two cords, wherein one of said cords is operatively connected to each of said retractor mechanisms.

4. The device of claim 1, wherein the second upright support comprises a riser with a top and a bottom, a generally horizontal arm extending out from the top of the riser and having an outer end, wherein the connector is located at or near the outer end of the horizontal arm.

5. The device of claim 3, wherein the second upright support comprises a riser with a top and a bottom, a generally horizontal arm extending out from the top of the riser in two directions and having two outer ends, and two connectors, one connector being attached to each of the two outer ends of the second upright support horizontal arm, two connectors at or near the outer ends, wherein the two cords are pulled from the first upright support to extend to and connect to the two connectors.

6. The device of claim 3, further comprising a sign hanging from the cord extending between the first upright support and the second upright support.

7. A display device for hanging items in the air, the device comprising:

a first upright support having a top and a bottom, a base on the bottom for resting on a generally horizontal surface, a generally vertical riser, having a generally horizontal arm extending from the top, so that the riser and horizontal arm lie in a vertical plane;

a cord having a proximal end and a distal end, the proximal end connected to the horizontal arm;

a retractor mechanism having a spool, the retractor mechanism attached to the horizontal arm and operatively connected to the cord to wind the cord on the spool; and a sign fastener attached to the horizontal arm for receiving a sign hanging parallel to the plane of the first upright support.

8. The device of claim 7, wherein the sign fastener extends substantially along the entire horizontal arm.

9. The device of claim 7, wherein the retractor mechanism comprises a spool inside the arm and to which the cord proximal end is attached, a handle extending out of the arm for access, and a hole through the arm through which the cord extends.

10. The device of claim 7, wherein the arm extends out two directions from the riser and has two outer ends, the device comprising two retractor mechanisms, one retractor mechanism being in each of the two outer ends, and two cords, wherein one of said cords is operatively connected to each of said retractor mechanisms.

* * * * *